United States Patent [19]

Urquiaga

[11] 4,310,368

[45] Jan. 12, 1982

[54] PROCEDURE FOR MANUFACTURING JAI ALAI BASKETS

[76] Inventor: Jose M. F. Urquiaga, calle Dr. Barraquer, 12 entl° 1, Castelldefels (Barcelona), Spain

[21] Appl. No.: 122,682

[22] Filed: Feb. 19, 1980

[51] Int. Cl.[3] ..... B32B 31/04; A63B 59/02

[52] U.S. Cl. ..... 156/148; 2/16; 2/160; 2/161 A; 156/290; 264/249; 264/254; 264/531; 273/326; 428/226; 428/232

[58] Field of Search ..... 2/16, 20, 160, 161 R, 2/161 A; 147/48; 156/93; 148, 290; 273/67 R, 326; 264/248, 249, 254, 514, 515, 516, 531; 428/226, 232

[56] References Cited

U.S. PATENT DOCUMENTS 642,638 2/1900 Smith ..... 273/326

3,930,091 12/1975 Lewis et al. ..... 156/148 X 4,045,026 8/1977 Gillespie et al. ..... 273/326

4,098,508 7/1978 Gandy ..... 273/326

*Primary Examiner*—Robert A. Dawson

*Attorney, Agent, or Firm*—Michael J. Striker

[57] ABSTRACT

An improved process for manufacturing Jai Alai baskets consists of forming the ring and separator as a molded plastic unit of either U-shaped or hollow cross-section. The ribs are similarly formed from plastic with holes so as to provide for a predetermined amount of flexibility. The ring unit and ribs are then placed in a detachable frame and either woven with plastic strips or welded to a series of parallel plastic strips. The strips are of rectangular cross-section and possess projections which are flattened by the projections of the colaterally located strips to protect the ribs. A glove is sewn on the basket.

8 Claims, 9 Drawing Figures

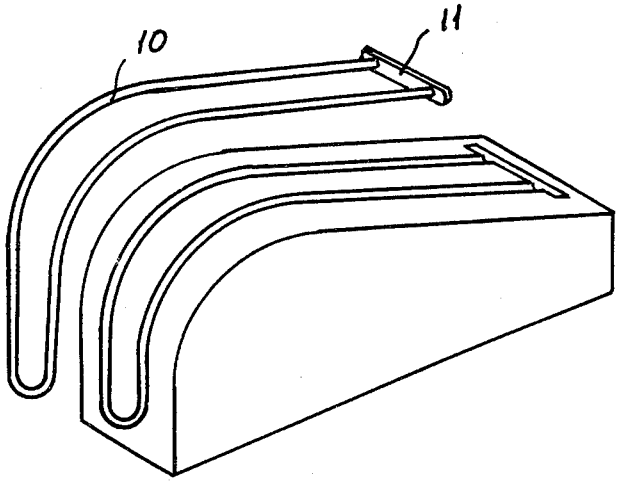
FIG. 1
FIG. 2
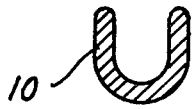
FIG. 3
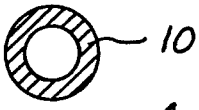
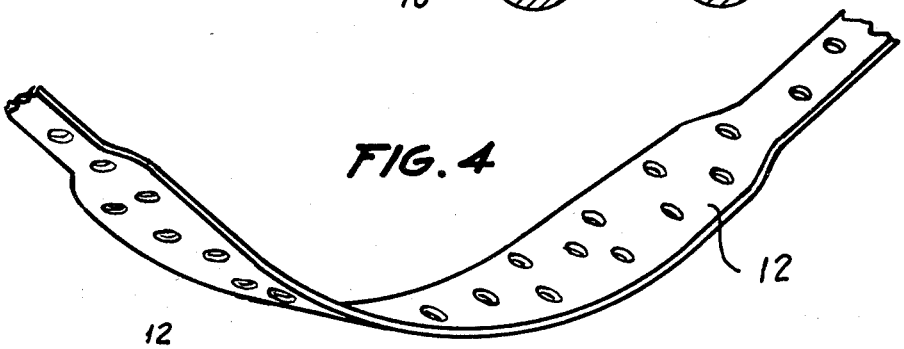
FIG. 4
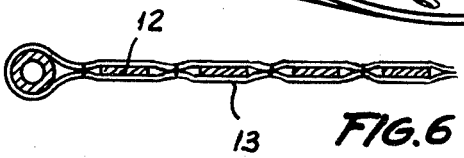
FIG. 6
FIG. 7
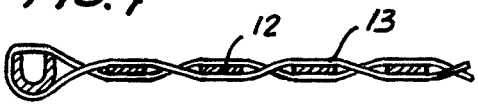

PROCEDURE FOR MANUFACTURING JAI ALAI BASKETS

BACKGROUND OF THE INVENTION

The present invention relates to a method of manufacturing of baskets utilized for playing the Jai Alai game.

Methods of manufacturing of baskets used for the Jai Alai game are known in the art. The baskets produced by known methods are very expensive since they are totally made by hand; the materials which are usually used for producing of the baskets are also made by hand.

Baskets used only for playing the game of Jai Alai are basically formed of a wooden ring, ribs and wickers. The wickers are utilized for stringing and covering the ring and the ribs. Wood usually used for manufacturing of the ribs is different from that used for the rings. It has been found disadvantageous that the baskets are made of materials of a very limited duration. In practice, after the baskets have been used they must be restored and restrung with maximum diligence. Such restringing of a basket is very expensive since it has to be made by hand and by highly qualified craftsmen.

On the other hand, the players of Jai Alai game found out that it is impossible in practice to find at least two baskets which are exactly the same since these baskets were produced manually. Therefore, the curvature of arch of different baskets varies in all cases so that a player using a new basket experiences difficulties in playing.

Still another disadvantage of the known baskets is that the baskets made of wood are extremely sensitive to humidity which causes their warping. When the same basket is used in a dry or humid environment it warps differently. This makes the use of the basket by a player very cumbersome.

Until now it has been practically impossible to use baskets of materials other than wood since it is rather difficult to obtain the same characteristics as those of wood for example, the same degree of elasticity or any other properties.

SUMMARY OF THE INVENTION

It is an object of the invention to provide an improved method of manufacturing baskets for the Jai Alai game.

Another object of the invention to provide baskets with some characteristics which are identical to those made of wood but have a better resistance to breaking and thus a longer life-span.

Still another object of the invention is to provide baskets with a greater uniformity so that a player will not notice any differences upon changing the baskets.

According to the invention the baskets are produced by forming a reinforced plastic ring by a single molding step.

Presently, the rings are formed first and thereafter they are connected to separators.

In order to provide a ring of the elasticity and weight identical to those of wood the ring is formed with a U-shaped cross-section or with a hollow interior. This cross-sectional configuration of the ring may be easily obtained because the material used for its molding has a mechanical strength which is much higher than that of wood; therefore the ring may be made with a thickness which is less than that presently used.

A greater bending may be obtained with non-wooden materials, this bending improving the efficiency of baskets due to a greater flexibility of the ring.

The use of the ring made of plastic material renders it possible to appreciably reduce the weight of the ring. This will be greatly appreciated by a player.

The flexibility of the ring is very important since it increases the speed of the ball to be thrown and practically eliminates the risks of breaking the ring which happens rather frequently with the baskets made of wood.

When the ring is molded in a conventional mold the ribs will be made of a hardened plastic material, also by molding. These ribs may be formed with small holes made along their length. These holes will increase the flexibility of the rings thereby increasing their resistance and elasticity coefficients.

After the ring and ribs have been molded they are assembled by means of a detactable frame whose configuration is substantially equal to that to which the basket will adopt. The ribs are thereafter easily inserted in place. The forming of the baskets is completed by stringing of the ring and ribs with a number of bands or strips made of extruded and cold-drawn plastic material.

The bands are made of a plastic material and are formed with a substantially prismatic cross-section. The bands are not very thick and have a fold directed slightly towards their lower area. This is very important because in conventional devices, particularly with plastic wickers used in baskets having a series of curvatures, the wickers remain separated from each other, particularly at the region of the largest radius of curvature so that the ribs of the basket are exposed.

The bands may have extensions on two side surfaces; these extensions may be flattened in the area of their intersecting. This causes a greater buffing effect of the impact of the ball when the latter falls into the basket.

Due to its flexibility and configuration the bands will adapt better to the contour of the ball thus noticeably effecting the ball during playing.

The utilization of bands of plastic material substantially increases their lifespan as compared to those presently used.

The wickers are inserted in place by conventional interweaving. Two bands may be placed parallel to each other and interconnected by means of spot welding. A glove is thereafter put in place and connected to the basket, for example by sewing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a ring made by means of conventional molding;

FIGS. 2 and 3 are sectional views of two different embodiments of the ring;

FIG. 4 is a perspective view of a rib;

FIG. 6 is a view showing a stringing step by means of a spot weld system;

FIG. 7 is a view of the stringing step by means of weaving of the strips; and

DESCRIPTION OF PREFERRED EMBODIMENTS

Figure 5:
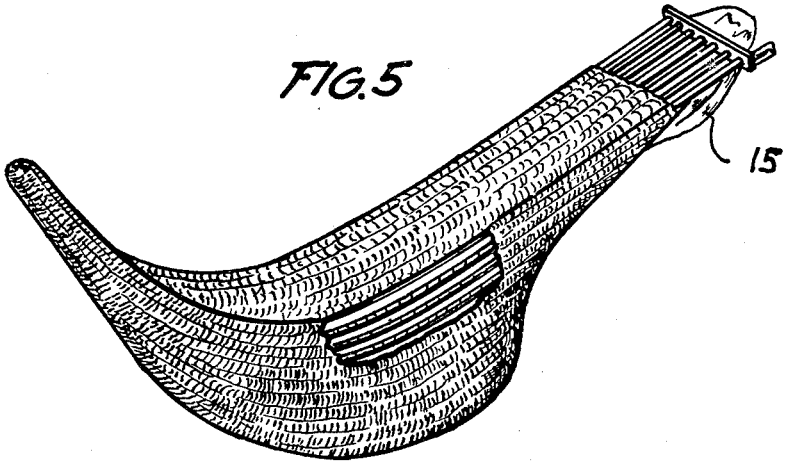
FIG. 5 is a perspective view of a basket.
Figure 8:
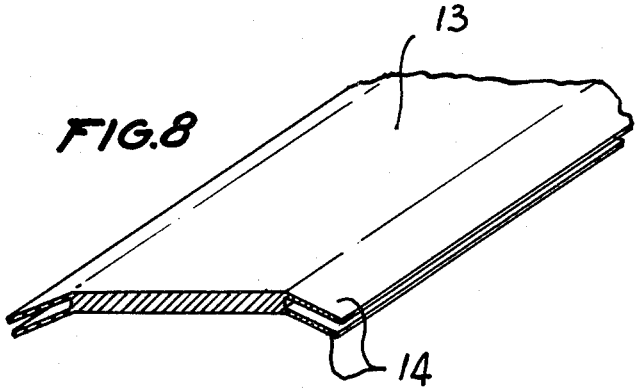
FIG. 8 is a perspective view of a band.
Figure 9:
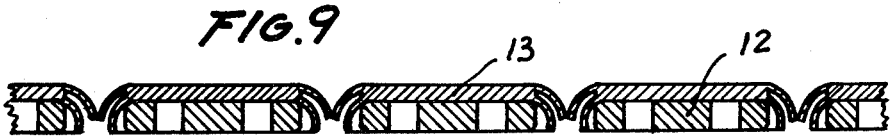
FIG. 9 is a cross-sectional view of the ribs with the bands attached.

The process of manufacturing of Jai Alai baskets starts with forming a ring 10 by a conventional molding. The ring 10 and a separator 11 illustrated in FIG. 1 are molded simultaneously. Presently these two elements are produced in two different operations and then the separator 11 is mounted on the ring 10.

In order to enable the ring 10 to achieve an elasticity and weight approximately equal to those of a ring made of wood, the section of this ring 10 is of a U-shaped configuration (see FIG. 2); or a small drilled hole is formed within the ring (see FIG. 3).

The purpose of such configurations is that due to the type of material used a mechanical resistance notably higher than that of wood is obtained. Therefore a section with appreciably large interior can be used in order to increase the flexibility of the ring which may be comparable to that of wood or be even greater than that of wood.

By increasing the elasticity and consequently obtaining a greater bending of the basket it will be possible to increase the exit speed of the ball when it is thrown, and thereby improve the final effect of playing. This may simultaneously eliminate the risks of breaking the ring, since the latter has a mechanical resistance much higher than the rings made of wood.

Once the ring 10 has been formed by molding, the molding of the ribs 12 of a hardened plastic material may proceed.

Since the material used for ribs has a resistance higher than that of the ribs that presently are made of wood, a series of small holes will be made in the ribs to increase their flexibility.

When the ball hits the ribs during the game they will adapt and will dampen the impact caused by the ball, thus avoiding very significant bounces in the basket.

After the ring 10 and ribs 12 have been made the mounting proceeds by means of a detachable frame whose configuration allows the perfect and exact placement of the corresponding ribs. In operation, this placement will be extremely rapid, since the ribs will have such configuration that they must adopt once the basket is finished.

After the placement of all the ribs and of the ring has been completed stringing of the entire subassembly with bands 13 made of extruded and cold-drawn plastic material begins.

These bands 13 are made of plastic material having a substantially rectangular cross-section with two side edges from which extensions 14 are projected. The extensions are not very thick. A slight fold directed towards the lower area of the band is formed therein.

The purpose of extensions 14 is to prevent the ribs 12 from being exposed. This exposure takes place in the baskets because the basket has a large amount of curvatures with radii which increase in proportion to the diameter whereas the width of the wickers remains constant; this will lead to the separation of the bands in the area of the largest curvature of arch of the basket and, consequently to the exposure of the ribs. By provision of the extensions 14 such exposure will be avoided since two bands or strips 13 will be placed in adjacent position in such a manner that the extensions 14 will be flattened by each other. Therefore, there always will be an area equal to the length of the two extensions and corresponding to two adjacent bands, which area will be covered by the extensions and the exposure of the ribs will be prevented even when the curvature of arc will broaden and cause the separation of two consecutive strips.

The buffing effect of the ball will be increased when the ball strikes the basket since the ball will adapt itself to the basket due to the structure of the basket.

It is possible to form the strips of plastic material by interweaving the strip over the ribs or by placing the strips parallel to each other and providing a series of connections therebetween by means of spot welding.

In order to complete the manufacturing of the basket a glove 15 is attached to the basket by any conventional means such as sewing.

It will be understood that each of the elements described above, or two or more together, may also find a useful application in other types of methods differing from the types described above.

While the invention has been illustrated and described as embodied in an improved procedure of manufacturing jai alai baskets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process of manufacturing Jai Alai baskets, comprising the steps of forming a plastic ring unit by molding; molding ribs from plastic; placing said ring unit and said ribs in a detachable springing frame so as to secure said ribs and said ring unit in the predetermined position required for stringing; obtaining strips of extruded plastic material each having a body of a substantially rectangular cross-section and extensions outwardly projecting therefrom, and stringing said ribs and said ring unit with said strips while simultaneously placing the extensions of the adjacent strips so that the extensions of the strips are flattened by the extensions of the colaterally located strips so as to form a basket suitable for playing Jai Alai.

2. The process as defined in claim 1, wherein said stringing step comprises the weaving of the strips so as to enmesh said ribs.

3. The process as defined in claim 1, wherein said stringing step comprises placing the strips parallel to each other and spot welding the strips to form a single unit.

4. The process as defined in claim 1, further comprising attaching a glove to the basket.

5. The process as defined in claim 4, wherein said glove is attached to said basket by sewing.

6. The process as defined in claim 1, wherein said ring unit has a hollow cross-section.

7. The process as defined in claim 1, wherein said ring unit has a U-shaped cross-section.

8. The process as defined in claim 1, wherein said ribs have small holes throughout their length so as to increase the flexibility of said ribs.

* * * * *